US008256062B2

(12) United States Patent
Banks et al.

(10) Patent No.: US 8,256,062 B2
(45) Date of Patent: Sep. 4, 2012

(54) DEVICE COMPRISING A GUIDE, RAIL SYSTEM AND TRANSPORT MECHANISM FOR USE IN SUCH A DEVICE

(75) Inventors: Adrian Banks, Haarlem (NL); Ruud Kaandorp, Castricum (NL)

(73) Assignee: Espero B.V., Waalwijk (NL)

( * ) Notice: Subject to any disclaimer, the term of this patent is extended or adjusted under 35 U.S.C. 154(b) by 618 days.

(21) Appl. No.: 12/394,696

(22) Filed: Feb. 27, 2009

(65) Prior Publication Data

US 2009/0217839 A1 Sep. 3, 2009

(30) Foreign Application Priority Data

Feb. 29, 2008 (NL) ..... 2001337

(51) Int. Cl.
*B61D 19/00* (2006.01)

(52) U.S. Cl. ..... 16/87 R; 16/95 R

(58) Field of Classification Search ..... 16/87 R, 16/107, 95 R, 96 R, 97, 102; 160/123, 330, 160/345, 196.1; 104/93, 99, 106; 49/409
See application file for complete search history.

(56) References Cited

U.S. PATENT DOCUMENTS 3,708,916 A * 1/1973 Karp et al. ..... 49/409
4,555,828 A * 12/1985 Matimura ..... 16/95 R
5,406,676 A 4/1995 Williams

FOREIGN PATENT DOCUMENTS

DE 2046429 A1 6/1972
DE 3147273 A1 * 7/1983
JP 09184350 A * 7/1997

* cited by examiner

*Primary Examiner* — William L. Miller
(74) *Attorney, Agent, or Firm* — The Webb Law Firm

(57) ABSTRACT

A device comprising a guide having a first pair of substantially parallel running surfaces, which are placed along a first track at a lateral distance apart, and a second pair of substantially parallel running surfaces, which are placed along a second track at a lateral distance apart. The second pair of running surfaces extends, at a crossing or junction, transversely to the first pair of running surfaces. A carrier is displaceable over at least the running surfaces and has a bearing axle, extending transversely to the running surfaces, for fastening of a load, which bearing axle extends between the running surfaces. The device, close to the crossing/junction, has a transport mechanism. The transport mechanism is movable between a take-up position in the first track, for load-bearing engagement with the carrier, and a delivery position in the second track, for release of the carrier. The invention further relates to a rail system and a transport mechanism.

17 Claims, 3 Drawing Sheets

DEVICE COMPRISING A GUIDE, RAIL SYSTEM AND TRANSPORT MECHANISM FOR USE IN SUCH A DEVICE

BACKGROUND OF THE INVENTION

1. Field of the Invention

The application relates to a device comprising a guide having a first pair of substantially parallel running surfaces, which are placed along a first track at a lateral distance apart, and a second pair of substantially parallel running surfaces, which are placed along a second track at a lateral distance apart, which second pair, at a crossing or junction, extends transversely to the first pair of running surfaces, and further comprising at least one carrier displaceable over the running surfaces, which carrier has a bearing axle, extending transversely to the running surfaces, for fastening of a load, which bearing axle extends between the running surfaces.

The application also relates to a rail system and a transport mechanism for use in such a device.

2. Description of Related Art

A device of the abovementioned sort, for the displacement of mobile wall panels along a rail system mounted on the ceiling, is known from U.S. Pat. No. 5,406,676. The known displaceable wall system comprises a rail in the form of a tubular extrusion profile. In the tubular profile, wheel sets of a carrier are guided with respectively two wheels placed one above the other, which wheels are rotatable about a vertically directed axle and are aligned substantially horizontally. The wheels have bevelled side faces, which engage with running surfaces of the extrusion profile. Upon displacement of the wall panels, the bottommost wheel runs over two bottommost running surfaces, and the above-situated wheel runs over a single topmost running surface. The wall panels are suspended from the vertical axle which extends downwards between the running surfaces.

The rails can comprise junctions, such as T-junctions and crossings. This makes it possible to manoeuvre the wheel sets at these sites in a plurality of directions. Should the wall panels be suspended from two placed-apart carriers, it is additionally possible to position the panel in a number of ways, by, for example, rotating the panel, in which case the panels move, of course, along differently orientated rails.

The wall panels of the known device can be displaced over the rails relatively easily and with little force. In addition, the wall panels can be flexibly positioned.

A drawback of the known device lies in the fact that at crossings, at least one of the running surfaces of the rails is interrupted and the wheel running thereon is not supported. This means that the remaining wheel gets to endure the full load of the wall panels. This makes the load-bearing capacity of the carrier limited, since the bearing load is defined by a single wheel. Owing to the large forces which are exerted upon the wheels and the rails when a crossing is passed through, the rails and the carrier have to be made of steel.

In addition, as a result of lack of support at a crossing or junction, the carrier will run somewhat out of the vertical. The unsupported wheel will hence move down somewhat. In order to bring the unsupported wheel back onto the running surface, the wheel must be raised. This requires a certain degree of strength and dexterity on the part of the user. This is particularly the case where very large or long panels are used, for example of 5-13 metres in length. In addition, it is not possible to carry out the displacement rapidly and with low force application by hand.

SUMMARY OF THE INVENTION

It is therefore an object of the invention to provide a reliable device for displacing relatively heavy objects, such as, for example, wall panels with a height of 5-13 m, along different tracks along a rail system, these objects being able to be displaced along branches and crossings of the rail system, in the desired direction, in an easy and manoeuvrable manner. It is additionally an object of the invention to provide a relatively lightly constructed rail system with which heavy objects can be accurately and easily displaced with low expenditure of force.

To this end, a transport mechanism is provided which is situated close to the crossing or junction and which is movable between a take-up position in the first track, for load-bearing engagement with the carrier, and a delivery position in the second track, for release of the carrier. The transport mechanism may be situated with an offset with respect to the centreline of the crossing or junction. The transport mechanism may be placed at a distance from the running surfaces. The transport mechanism may be used to engage the carrier, transport the carrier over the crossing or junction, and release the carrier in the second track. As a result of the movable transport mechanism, the load is temporarily taken over in the region of an interruption of the running surfaces. The user can hence move the carrier along a crossing or branch with a continuous movement. By virtue of the fact that the carrier no longer sinks in the interruption of the running surfaces, but is supported close to the crossing or junction by the transport mechanism, the rail system is not subjected to unnecessarily heavy load, so that this can be lightly constructed, for example as an aluminium extrusion profile.

The carrier according to the an embodiment may comprise a slide block, but may also be constructed, for example, as one or more wheels arranged rotatably about a wheel axle. The axle of the wheels can extend parallel to the running surfaces. In an embodiment, the axle of the wheels is situated transversely to the running surfaces, as described in U.S. Pat. No. 5,406,676. The load-bearing axle here extends in the extension of the wheel axle of the at least one running wheel, which with bevelled side faces rolls over the running surfaces.

The load which can be displaced with the device may comprise any load, such as an object which is moved through a room, such as in the assembly or manufacture of a product, a foodstuff, or some other object. The load may be formed by a wall panel having a relatively large dimension, such as a height of between 5 m and higher, for example 13-20 m. These panels can be guided manually by the user along the tracks to a desired position, such as a functional position, which divides a room into parts, and a parking position, in which the panels are placed flat one against the other. Through the use of the carrier according to an embodiment, the runners of the panels, close to a branch or crossing, are supported such that the panels can be quickly and easily manipulated along the branch or crossing with just slight application of force, so that the panels can be brought easily into position even by less strong members of staff The rails and especially the running surfaces can be lightly constructed, so that a wall system is obtained which can be easily transported and assembled and which is relatively cheap.

In one embodiment, the transport mechanism comprises a supporting body which is pivotable. The pivotable construction of the transport mechanism ensures a simple movement of the supporting body in its movement from the take-up position into the delivery position. The transport mechanism can hence be made relatively simply and cheaply. In an embodiment, the rotation axle extends perpendicular to the running surfaces. This construction ensures that the play of forces upon the transport mechanism during the movement from the take-up position to the delivery position remains relatively equal. This simplifies the required construction of the transport mechanism. The supporting body may be pivotable around a pivot axis. The pivot axis may be, in an embodiment, positioned with an offset with respect to the centre of the crossing or junction.

In one embodiment, the running surfaces are fastened to side walls situated transversely to the running surfaces, the carrier being situated between the side walls and the pivot axle being mounted close to the crossing or junction along an outer side of the side walls. The side walls, close to the pivot axle, may have a slot through which the transport mechanism reaches to between the side walls. The mounting of the pivot axle on the outer side of the side walls and the provision of a slot in the side walls of the rails ensures that existing rail systems can be adapted and can be provided with a transport mechanism by retrofitting. On the outer side of the side walls there is additionally enough place for the mounting of the transport mechanism. The transport mechanism can hence be made sufficiently strong. The placement of the pivot axle at a distance from the running surfaces, in combination with a transport mechanism reaching to between the running surfaces, also ensures that an accurate transfer of the carrier from a first track to a second track is possible.

In an embodiment, the transport mechanism comprises a disc-shaped body having a bearing surface situated substantially parallel to the running surfaces. The use of a disc-shaped body, in combination with the placement of the pivot axle outside the side walls of the rails, ensures that the transport body is always in a correct position to receive the carrier. The rim of the disc can comprise at least two cavities, following one behind the other in the peripheral direction. The cavities are suitable for receiving the carrier therein. The carrier is hence positioned relatively stably as the carrier is transferred from the first to the second track.

The disc-shaped body can be realized such that it has along the periphery at least two locking slots, which cooperate with a stop member, arranged fixedly with respect to the pivot axle, for securing the disc-shaped body in a predetermined angular position. The stop member can be, for example, an engaging element, which engages in a locking slot. The predetermined angular position can be, for example, a position of the transport mechanism which is receptive to the carrier. The transport mechanism, if not in use, can hence no longer move involuntarily out of this receiving position.

In one embodiment, at least one running surface of each track is realized as a first running surface, the device further comprising a second running surface situated at a transverse distance above the first, and the carrier comprising two bevelled wheels situated at a transverse distance apart, which are rotatable about a wheel axle situated transversely to the running surfaces, which wheels engage with their bevel with respective running surfaces situated at a transverse distance apart. This embodiment has the advantage that the transport mechanism can easily engage with the wheel supported by a running surface. The wheel axle situated transversely to the running surfaces makes it possible to easily engage the carrier. This simplifies the transport from the first track to the second track in case of a change of direction.

It is possible that in a load-bearing position of the transport mechanism, the upper bevelled wheel engages with the transport mechanism. Additionally, the lower bevelled wheel may engage the first running surface. This way, both wheels are continuously supported during the transport.

In an embodiment, the first and second pair of running surfaces intersect at equal height. The carrier can hence be transferred at a same height. Accordingly, there are no height differences which need to be bridged. This simplifies the construction and guarantees a minimal expenditure of force by a user in the displacement of a panel and the transfer of the carrying device from a first track to a second track.

Individual embodiments will be explained in greater detail below with reference to the following figures, in which:

DETAILED DESCRIPTION OF THE INVENTION

Figure 1:
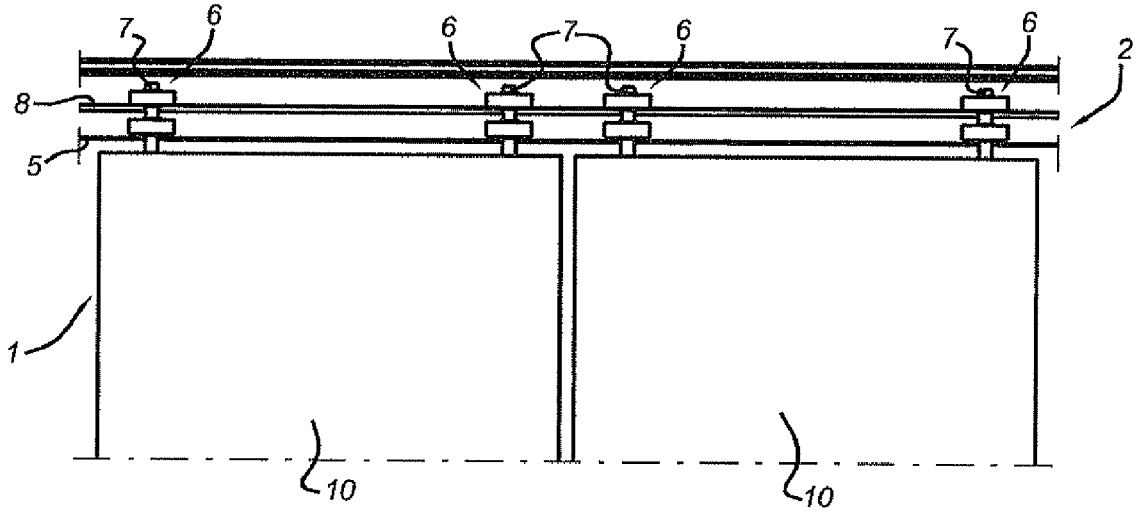
FIG. 1 shows a side view of a device for displaceably suspended panels according to the prior art.

FIG. 1 shows a known device 1 for displaceably suspended panels 10 according to the prior art. The device 1 comprises a guide 2 having substantially parallel running surfaces 5, 8. The device 1 comprises carriers 6 suspended displaceably over the running surfaces 5, 8. The carrier 6 has a bearing axle 7, extending transversely to the running surfaces 5, for fastening of a load 10, such as, for example, a wall panel. The bearing axle 7 extends between the running surfaces 5, 8, as shown in FIG. 2.

Figure 2:
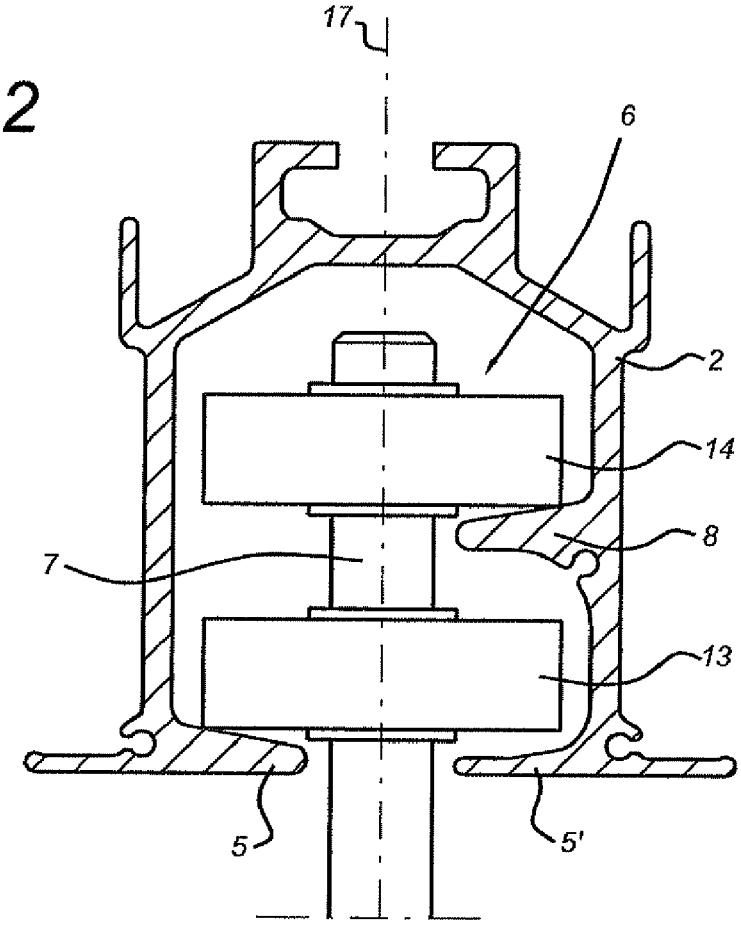
FIG. 2 shows a cross-sectional view of a carrier for a device for displaceably suspended panels according to the prior art along the line II-II.

FIG. 2 shows a detail of a cross section of a carrier 6 in a guide 2 of a device 1 for displaceably suspended panels 10 according to the prior art. The carrier 6 comprises a bearing axle 7, which reaches to between the running surfaces 5, 8. The carrier may have two bevelled wheels 13, 14, which are situated at a transverse distance apart and are rotatable about a wheel axle 17 situated transversely to the running surfaces 5, 8. The wheels engage with their bevel with respective running surfaces 5, 8 situated at a transverse distance apart. The device 1 for displaceably suspended panels can comprise intersections, where different supporting rail segments meet. It is thus possible to displace panels in a desired direction.

Figure 3A:
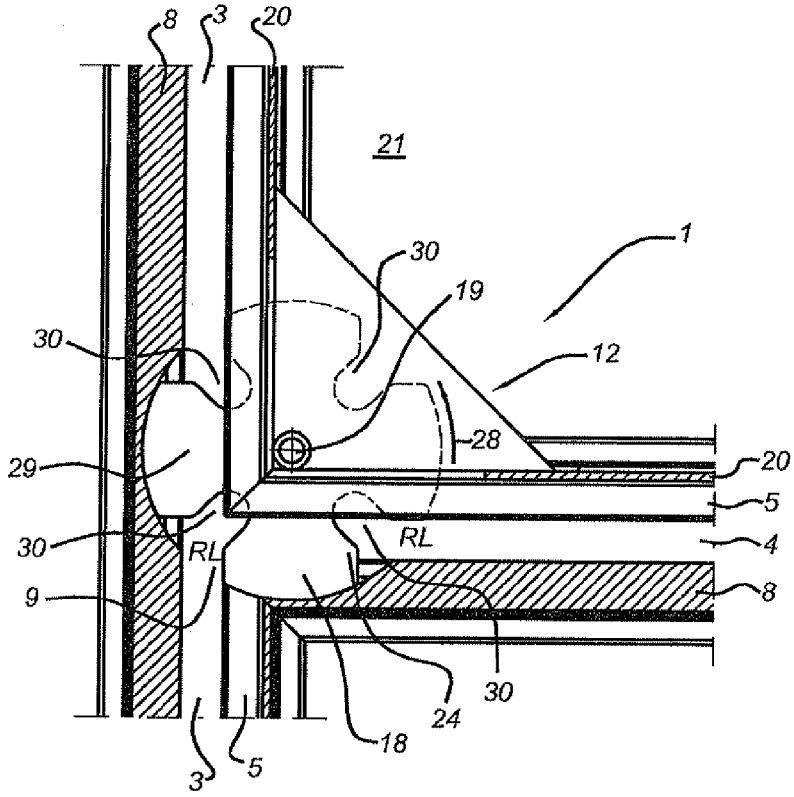
FIGS. 3*a* and 3*b* respectively show a top view and a perspective view of a device comprising three supporting rail segments and a transport mechanism.

FIG. 3*a* shows a cross-sectional top view of a device 1 having a first pair, placed along a first track 3, of substantially parallel running surfaces 5, 8 situated at a lateral distance apart. Extending transversely to the first track 3 is a second track 4. The second track 4 comprises substantially parallel running surfaces 5, 8 situated at a lateral distance apart. A carrier, as shown in FIG. 2, is displaceable over the running surfaces 5, 8.

Figure 3B:
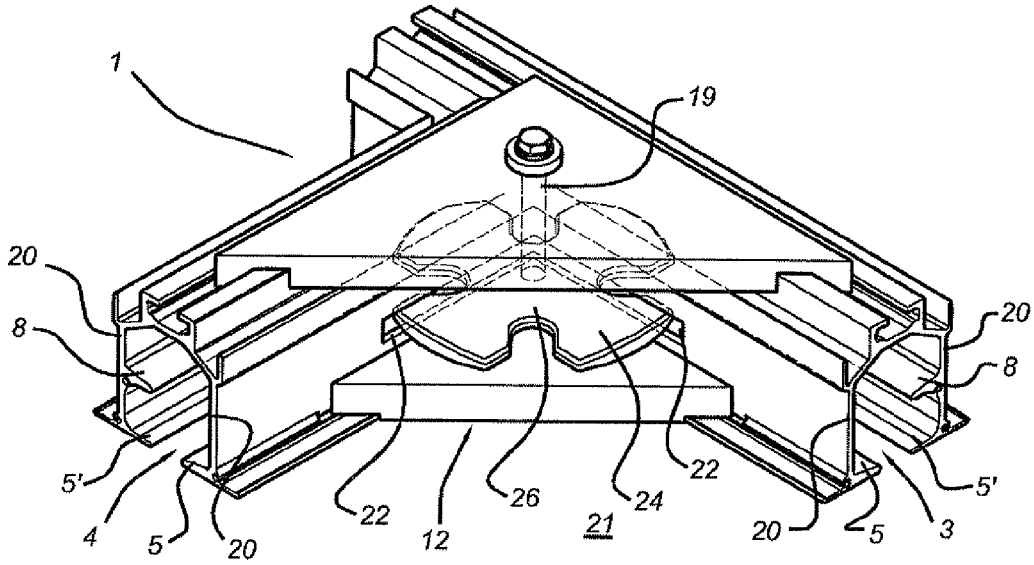

FIG. 3*b* shows the same junction in a perspective view. The first track 3 and the second track 4 form a substantially T-shaped junction 9. The device 1, close to the junction 9, has a transport mechanism 12. The transport mechanism 12 may be mainly aligned into the corner formed by the two tracks at the junction. The transport mechanism may be attached by means of one or two reinforcing elements. The reinforcing elements may, for instance, be triangular plates. The plates may be connected to the first and second rail. For instance, one plate may be connected to the top of the two rails, and one plate may be connected to the bottom of the two rails. In between the plates, the transport mechanism may be provided. The transport mechanism 12 is movable between a take-up position RC in the first track 3, for load-bearing engagement with the carrier 6, and a delivery position in the second track 4, for release of the carrier.

In the shown embodiment, the transport mechanism 12 comprises a supporting body 18. The supporting body 18 is rotatable about a pivot axle 19. The pivot axle 19 stands or extends perpendicular to the running surfaces 5, 8. The running surfaces 5, 8 are placed transversely to side walls 20, and the carrier is displaceable between the side walls 20 over the running surfaces 5, 8. The pivot axle 19 of the transport mechanism 12 is mounted along an outer side 21 of the side walls 20. Close to the pivot axle 19 there is placed a slot 22 through which the transport mechanism 12 reaches to between the running surfaces 5, 8.

Figure 4:
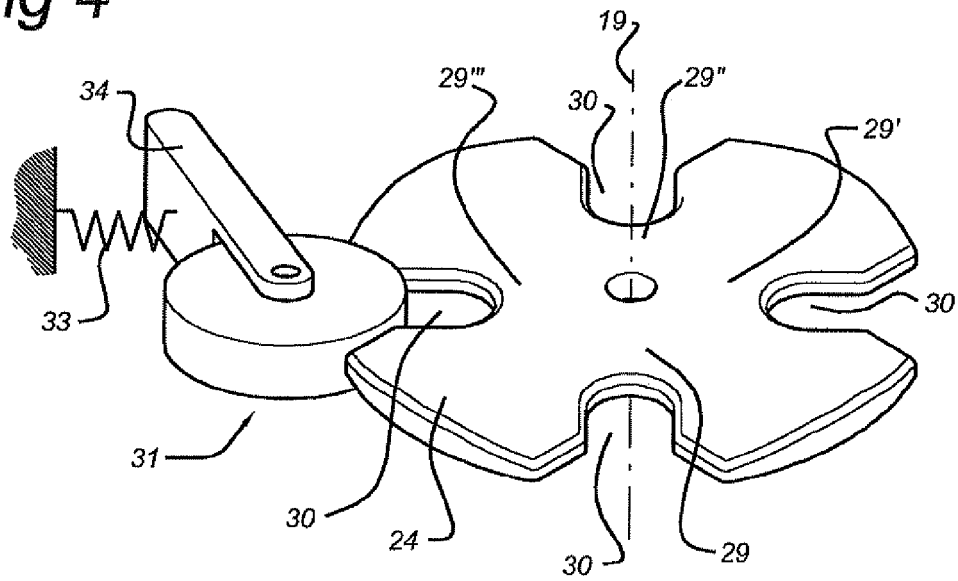
FIG. 4 shows a perspective view of a transport mechanism.

The transport mechanism 12 can comprise a disc-shaped body 24. FIG. 4 shows one embodiment of the disc-shaped body 24, having a bearing surface 26 situated substantially parallel to the running surfaces. The disc-shaped body comprises at least two cavities 29, following one behind the other in the peripheral direction 28. The disc-shaped body shown in FIG. 4 comprises four cavities 29, 29', 29", 29'''. The cavities serve for the stable and supportive reception of the unsupported wheel of the carrier as the carrier is transported on the transport mechanism from a take-up position RC to a delivery position RL.

In addition, the disc-shaped body shown in FIG. 4 comprises four locking slots 30, which cooperate with a spring-loaded stop member 31 which is fixedly arranged with respect to the pivot axle 19. The stop member 31 ensures that the disc-shaped body 24 can undergo no unwanted rotations. The disc-shaped body, if not in use, will hence always be in a receptive position for the take-up, transportation and, subsequently, delivery of the carrier. It is possible to provide the disc-shaped body 24 with more or fewer locking slots. In an embodiment, the disc-shaped body 24 has at least two locking slots 30. The locking slots 30 can also be realized in such a way that they additionally serve for the guidance and take-up of a bearing axle 7 of a carrier 6 according to FIG. 2, for the purpose of making the transport mechanism 12 engage with the carrier in a load-bearing manner.

The working of one embodiment of the transport mechanism 12 will be subsequently explained with reference to FIGS. 3*a* and 3*b*. The carrier 6, in an embodiment as shown in FIG. 2, is displaceable along a first track 3 of the device 1. The carrier here runs with a first wheel 13 over a first running surface 5 and with a second wheel 14 over a second running surface 8. When the carrier 6 gets to the junction 9, it will fall with the bearing axle 7 into a locking slot 30 of the transport mechanism 12, which is in a take-up position RC. The second wheel 14 of the carrier will be lifted from the second running surface 8 and will land on a cavity 29 of the disc-shaped body 24 of the transport mechanism 12. The transport mechanism will now engage with the carrier in a load-bearing manner.

As a result of the spring-loaded stop member 31, which cooperates with the locking slots 30 of the disc-shaped body 24, the latter will encounter some rotational resistance. The user then notices that the carrier 6 is at or close to the junction 9, whereafter the user has the option of making the carrier 6 undergo a change of direction. In the embodiment shown in FIGS. 3*a* and 3*b*, the user has the option of moving the carrier farther along the first track 3. In addition, the user has the option of moving the carrier to the second track 4. The user has subsequently to move the carrier onward in the desired direction. The disc-shaped body 24 will here rotate over a predetermined angular distance, after which the transport mechanism 12 finds itself in a delivery position. If the transport mechanism has a stop member 31, this in the delivery position will re-engage with a locking slot 30. The user then knows that the disc-shaped body 24 is back in a delivery position. The user can then move the carrier onward in the desired direction. The user may decide to reuse the transport mechanism 12 to displace the carrier in another direction or into another track.

Possible embodiments of the junction 9 in which the transport mechanism 12 is usable are shown in FIGS. 5*a-e*.

Figure 5A:
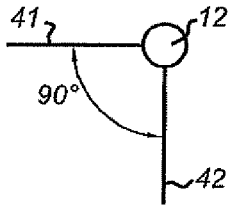
FIGS. 5*a-e* show top views of embodiments of junctions.

FIG. 5*a* shows a junction 9, which has a first rail 41 and a second rail 42. The two rails make an angle of 90° to each other. The rails each comprise a guide having running surfaces over which a carrier is movable. The transport mechanism ensures that the carrier is easily movable through the right angle.

Figure 5B:
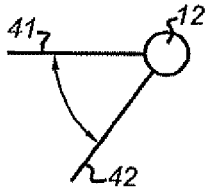

FIG. 5*b* shows an embodiment as in FIG. 5*a*, only that the two rails now make an angle to each other which is equal to $\alpha$.

Figure 5C:
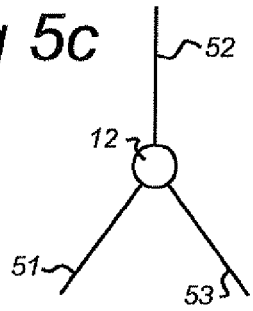

The device can additionally comprise three rails 51,52,53, the rails mutually possessing an equal angular spacing, as shown in FIG. 5*c*. It is further possible to vary the angles one to another.

Figure 5D:
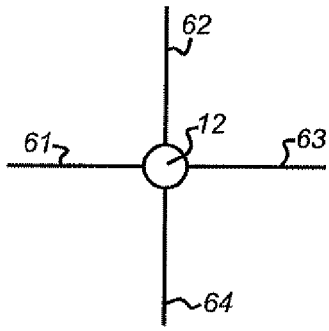

It is possible to use the device to create a junction having four rails. The angles between the rails can in this case vary. In FIG. 5*d*, a particularly advantageous embodiment is represented. The junction here has four rails 61, 62, 63, 64, which form a crossing. In the middle is placed a transport mechanism 12. This embodiment makes it possible to use a crossing in the device, the transport mechanism engaging with the carrier in a load-bearing manner. The carrier can here be placed from a first branch onwards on the transport mechanism. The user can subsequently move the carrier rotatably in the direction of the different delivery positions. The transport mechanism can here act as a carrousel. Once the carrier has the desired position, the user can move the carrier onward in the desired direction.

Figure 5E:
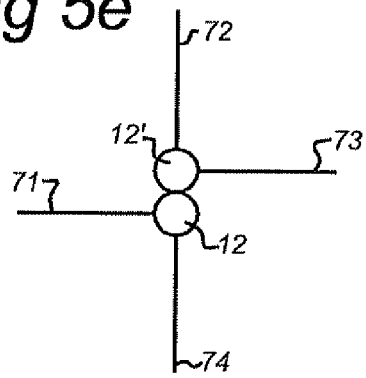

Other embodiments of junctions are, of course, conceivable. For instance, it is possible to use more than four rails, or place different transport mechanisms relatively close together, in order to obtain a desired junction. In FIG. 5*e* an embodiment is shown in which a transport mechanism 12 having a first track 74 and a second track 71 is connected to a transport mechanism 12' having a first track 73 and a second track 73. The carrier can then be moved from the first transport mechanism 12 to the second transport mechanism 12'. In this way, an alternative crossing having four tracks is feasible.

It will be apparent to the person skilled in the art that the invention is not limited to what has been described here and that several equivalent embodiments of the invention are possible.

The invention claimed is:

1. A device comprising a guide having a first pair of substantially parallel running surfaces, which are placed along a first track at a lateral distance apart, and a second pair of substantially parallel running surfaces, which are placed along a second track at a lateral distance apart, wherein the first and second pair of running surfaces are connected to side walls extending transversely to the respective first and second pair of running surfaces, wherein the second pair of running surfaces, at a crossing or junction, extends transversely to the first pair of running surfaces, and the device further comprising at least one carrier displaceable over either one of the first and second pair of running surfaces, which carrier comprises a bearing axle, extending transversely to the running surfaces of each of the first and second pair of running surfaces, for fastening of a load, which bearing axle extends between the running surfaces of each of the first and second pair of running surfaces, wherein the device comprises, close to the crossing or junction, a transport mechanism, which is movable between a take-up position in the first track, for load-bearing engagement with the carrier, and a delivery position in the second track, for release of the carrier, wherein the transport mechanism comprises a supporting body, which is pivotable about a pivot axle which extends perpendicular to the running surfaces of the first and second pair of running surfaces, wherein the carrier is situated between the side walls and the pivot axle is mounted close to the crossing or junction along an outer side of the side walls.

2. The device according to claim 1, wherein the side walls, close to the pivot axle, comprise a slot through which the transport mechanism reaches to between the side walls.

3. The device according to claim 1, wherein the transport mechanism comprises a disc-shaped body having a bearing surface situated substantially parallel to the first and second pair of running surfaces and comprising at least two cavities, following one behind the other in the peripheral direction, wherein each cavity is associated with a locking slot.

4. The device according to claim 3, wherein each locking slot adapted to cooperate with a stop member, is arranged fixedly with respect to the pivot axle, for securing the disc-shaped body in a predetermined angular position.

5. The device according to claim 4, wherein the stop member is an engaging element for engaging in the locking slot.

6. The device according to claim 5, wherein the predetermined angular position is a position wherein the transport mechanism is receptive to the carrier.

7. The device according to claim 1, wherein at least one running surface of each of the first and second track is realized as a first running surface and a second running surface situated at a transverse distance above the first, the carrier comprising a lower beveled wheel and an upper beveled wheel situated at a transverse distance apart, which are rotatable about a wheel axle situated transversely to the running surfaces, which lower and upper beveled wheels engage with respective running surfaces situated at a transverse distance apart.

8. The device according to claim 7, wherein, in a load-bearing position of the transport mechanism, the upper beveled wheel engages with the transport mechanism.

9. The device according to claim 1, wherein the first and second pair of running surfaces intersect at equal height.

10. The device according to claim 1, wherein at least two carriers are provided for fastening of at least two loads, wherein the at least two loads are independently movable.

11. The device according to claim 1, wherein at least two carriers are provided for fastening of a single load thereto, the at least two carriers being spaced in a longitudinal direction of the guide.

12. The device according to claim 1, wherein the load is a wall panel.

13. A rail system comprising a first pair of substantially parallel running surfaces, which are placed along a first track at a lateral distance apart, and a second pair of substantially parallel running surfaces, which are placed along a second track at a lateral distance apart, wherein the first and second pair of running surfaces are fastened to side walls situated transversely to the first and second pair of running surfaces, wherein the second pair of running surfaces, at a crossing or junction, extends transversely to the first pair of running surfaces, wherein the rail system comprises a transport mechanism, which, close to the crossing or junction, extends movably between the running surfaces of the first and second pair of running surfaces and is movable between a take-up position in the first track, for load-bearing engagement with a carrier, and a delivery position in the second track, for release of the carrier, the transport mechanism comprising a supporting body, which is pivotable about a pivot axle which extends perpendicular to the first and second pair of running surfaces, wherein the pivot axle, close to the crossing, is mounted along an outer side of the side walls.

14. The rail system according to claim 13, wherein the side walls, close to the pivot axle, comprise a slot through which the transport mechanism reaches to between the first and second pair of running surfaces.

15. The rail system according to claim 13, wherein the transport mechanism comprises a disc-shaped body having a bearing surface situated substantially parallel to the first and second pair of running surfaces and comprising at least two cavities, following one behind the other in the peripheral direction, wherein each cavity is associated with a locking slot.

16. The rail system according to claim 15, wherein each locking slot adapted to cooperate with a stop member, is arranged fixedly with respect to the pivot axle, for securing the disc-shaped body in a predetermined angular position.

17. The rail system according to claim 13, wherein the junction is a T-junction.

* * * * *